US006436236B1

(12) United States Patent
Hartzler

(10) Patent No.: US 6,436,236 B1
(45) Date of Patent: Aug. 20, 2002

(54) ELECTRICALLY-CONDUCTIVE PARA-ARAMID PULP

(75) Inventor: Jon David Hartzler, Midlothian, VA (US)

(73) Assignee: E. I. du Pont de Nemours & Company, Wilmington, DE (US)

( * ) Notice: Subject to any disclaimer, the term of this patent is extended or adjusted under 35 U.S.C. 154(b) by 0 days.

(21) Appl. No.: 09/799,368

(22) Filed: Mar. 5, 2001

(51) Int. Cl.[7] ..... D21F 11/00

(52) U.S. Cl. ..... 162/157.3; 162/138; 162/146

(58) Field of Search ..... 162/138, 146, 162/148, 157.1, 157.2, 157.3, 164.1, 164.5, 182, 183; 252/500, 502, 510; 428/364, 395; 264/105

(56) References Cited

U.S. PATENT DOCUMENTS

| | | | | | |
|---|---|---|---|---|---|
| 5,094,913 | A | | 3/1992 | Yang | 428/364 |
| 5,248,554 | A | | 9/1993 | Hsu | 428/395 |
| 5,274,071 | A | | 12/1993 | Santa et al. | 528/329.1 |
| 5,378,404 | A | * | 1/1995 | Han et al. | 252/500 |
| 5,470,505 | A | * | 11/1995 | Smith et al. | 252/500 |
| 5,532,059 | A | | 7/1996 | Lee | 428/359 |
| 5,759,348 | A | * | 6/1998 | Yamabayashi et al. | 162/157.3 |
| 5,788,897 | A | * | 8/1998 | Hsu | 264/184 |
| 5,882,566 | A | * | 3/1999 | Hsu et al. | 264/210.6 |
| 5,989,696 | A | * | 11/1999 | McCarthy et al. | 428/288 |
| 5,998,026 | A | * | 12/1999 | Ramachandran | 428/372 |
| 6,011,118 | A | * | 1/2000 | Asagi et al. | 525/178 |
| 6,017,610 | A | * | 1/2000 | Abe et al. | 428/195 |

FOREIGN PATENT DOCUMENTS

| | | | |
|---|---|---|---|
| EP | 0-355-518 A2 | 2/1990 | D01F/11/04 |
| JP | 53-111120 | 9/1978 | D01F/6/60 |
| JP | 59-163418 | 9/1984 | D01F/6/90 |

* cited by examiner

*Primary Examiner*—Peter Chin
*Assistant Examiner*—Eric Hug

(57) ABSTRACT

The present invention relates to electrically-conductive pulp of sulfonated polyaniline blended with para-aramid wherein the para-aramid is a continuous phase in the pulp and the sulfonated polyaniline is a discontinuous phase.

7 Claims, No Drawings

ELECTRICALLY-CONDUCTIVE PARA-ARAMID PULP

BACKGROUND OF THE INVENTION

1. Field of the Invention.

This invention relates to an electrically-conductive aramid pulp composition that has high surface area, a high concentration of fibrils and increases strength and high modulus as polymeric reinforcement.

2. Description of Related Art.

U.S. Pat. Nos. 5,788,897 and 5,882,566, issued Aug. 4, 1998 and Mar. 16, 1999, respectively, disclose fibers having a continuous phase of para-aramid and a discontinuous phase of electrically-conductive sulfonated polyaniline.

U.S. Pat. No. 5,094,913, issued Mar. 10, 1992, discloses a pulp refined from fibers having a continuous phase of para-aramid and a discontinuous phase of meta-aramid.

Japanese Patent Publication (Kokai) No. 59/163418, published Sep. 14, 1984, discloses pulp beaten from fibers of a blend of para-aramid and aliphatic polyamide.

BRIEF SUMMARY OF THE INVENTION

This invention includes a composition in the form of a pulp comprising a blend of 65 to 95 weight percent of para-aramid and 5 to 35 weight percent of sulfonated polyaniline (SPA) wherein the para-aramid is present in the composition as a continuous phase and the SPA is dispersed throughout the para-aramid. Pulp particles in the composition generally have a specific surface area of greater than 7.5 $m^2/g$ and a Canadian Standard Freeness of less than 150 milliliters.

Paper made from the pulp of this invention exhibits a charge decay rate of less than 5 seconds.

DETAILED DESCRIPTION OF THE INVENTION

Electrically conductive pulp is a very desirable product for use in reinforcement of packaging films and polymers, generally, and especially where there is a need to drain or dissipate electrical charges. Electrically conductive pulp finds use in applications where handling dielectric pulp, in dry form, results in charged particles that are difficult to handle or are dangerous due to a threat of sparking on discharge.

This invention utilizes an intimate blend of two polymeric materials to provide a pulp that is not only a good reinforcement for other polymers but is, also, electrically conductive to impart electrical conductivity to normally dielectric materials into which it is added for reinforcement. Fibers of combined polymers are known. Particularly fibers of para-aramid combined with other polymers—and even polyaniline polymers—are known. However, there has been, up to now, no suggestion that such fibers might be refined to make conductive pulp materials.

This invention provides a pulp product that is not only an excellent reinforcement material, is also extremely effective for electric charge dissipation. Moreover, the very material good for such charge dissipation is the material that creates ease in pulp manufacture and excellence in pulp quality.

The materials of this pulp product are para-aramid and SPA and the SPA component provides a dual function with the purposes widely divergent and largely unrelated. First, the polyaniline, as a secondary component in the blend, provides points of fracture for refining and pulping forces to achieve efficient and effective manufacture of high quality pulp with fine, long, fibrils. Second, the polyaniline, as a component effectively on the surface of the pulp particles, provides an electrical conductivity that is effective in dissipating electrical charge by contact of the fibrils on adjacent pulp particles.

By "aramid" is meant a polyamide wherein at least 85% of the amide (—CO—NH—) linkages are attached directly to two aromatic rings. Aramid fibers are described in Man-Made Fibers—Science and Technology, Volume 2, Section titled Fiber-Forming Aromatic Polyamides, page 297, W. Black et al., Interscience Publishers, 1968. Aramid fibers are, also, disclosed in U.S. Pat. Nos. 4,172,938; 3,869,429; 3,819,587; 3,673,143; 3,354,127; and 3,094,511.

Para-aramids are the primary polymers of this invention for blending with polyaniline; and poly(p-phenylene terephthalamide) is the preferred para-aramid. By para-aramid is meant the homopolymer resulting from mole-for-mole polymerization of para-phenylene diamine and terephthaloyl chloride and, also, copolymers resulting from incorporation of small amounts of other diamines with the para-phenylene diamine and of small amounts of other diacid chlorides with the terephthaloyl chloride. As a general rule, other diamines and other diacid chlorides can be used in amounts up to as much as about 30 mole percent of the para-phenylene diamine or the terephthaloyl chloride, or perhaps slightly higher, provided only that the other diamines and diacid chlorides have no reactive groups that interfere with the polymerization reaction. Para-aramid, also, means copolymers resulting from incorporation of other aromatic diamines and other aromatic diacid chlorides such as, for example, 2,6-naphthaloyl chloride or chloro- or dichloroterephthaloyl chloride; provided, only that the other aromatic diamines and aromatic diacid chlorides be present in amounts which permit preparation of anisotropic spin dopes. Preparation of para-aramids and processes for spinning fibers from the para-aramids are described in U.S. Pat. Nos. 3,869,429; 4,308,374; 4,698,414; and 5,459,231.

Sulfonated polyaniline of the present invention can be made by in-situ ring-sulfonation. The term "insitu ring-sulfonation" means that the polyaniline is sulfonated during the polymer solutioning process and not isolated from the sulfuric acid solution before the solution is spun into a fiber. Of course, the sulfonation can, also, be achieved in any other way to make sulfonated polyaniline leading to a conductive pulp.

To be effective in practice of this invention, the sulfonated polyaniline must be sulfonated to a degree that will provide adequate conductivity to drain electrical charges. It has been found that sulfonation is required to a sulfur content of at least 8.5 percent, based on total weight of the sulfonated polyaniline. Sulfonation of less than that amount, results in generally inadequate fiber conductivity. It has, also, been found that increased sulfonation yields improved performance up to a sulfonation level of about 15 weight percent sulfur, based on total weight of the sulfonated polyaniline. Sulfonation to a greater degree has been found to be of little additional benefit. It is noted that sulfonation of polyaniline, to a degree of 8.5 to 15 weight percent, corresponds to a mol percent sulfonation of about 30 to 70 percent of the polyaniline repeat units.

The pulp of this invention can be made by so-called air gap spinning of anisotropic spin dope including the para-aramid and the sulfonated polyaniline. Preparation of such spin dope and spinning of fibers to serve as the basis for the pulp used in this invention, can be found in aforementioned U.S. Pat. Nos. 5,788,897 and 5,882,566.

The molecular weight of the polyaniline employed in the pulp of this invention is not critical. Polyaniline of low molecular weight may result in lower solution viscosity and easier processing, however, it might be more readily removed from the fiber in processing or use.

High molecular weight para-aramid is used—having an inherent viscosity of at least 5. In order to obtain pulp of the desirable high strength and modulus, a spin dope concentration of the para-aramid is employed that results in an anisotropic dope as discussed in U.S. Pat. No. 3,767,756. Spin dopes containing at least 13% by wt. of total polymer content, that is, sulfonated polyaniline plus the p-aramid, meet this requirement. Otherwise the mechanical properties of the spun fiber will not be acceptable for preparation of the pulp to provide antistatic properties.

The concentration of sulfonated polyaniline in para-aramid in the spin solution, and ultimately in the spun fiber and the pulp product, has an important influence on properties. As the content of sulfonated polyaniline increases to and exceeds 40 wt % of the polymer mixture, the tensile strength of the fiber becomes undesirably reduced with no concomitant increase in electrical conductivity. Also, in washing fibers with such a high concentration of polyaniline, some of the insitu ring-sulfonated polyaniline may be extracted.

The ring-sulfonated polyaniline should constitute at least 3 weight percent and preferably more than 5 weight percent of the pulp product to provide a charge decay rate of less than about 5 seconds. The ring-sulfonated polyaniline should constitute from 3 to 40 weight percent and preferably from 5 to 30 weight percent of the fibers, based on the polymer mixture with calculations using unsulfonated polyaniline.

To make the pulp of this invention, fibers that have been spun as described above, are cut into uniform lengths of 0.5 to 2.5 cm and are suspended in water to form a floc that is subjected to high shear conditions to produce pulp. Equipment useful for refining cellulosic fibers, such as refiners having abrading elements that rotate relative to one another, is useful for this purpose. In pulping in accordance with this invention, shearing along boundaries between the para-aramid and polyaniline phases results readily in the formation of high quality pulp particles with excellent pulp length and high degree of fibrillation. The presence of the polyaniline domains provides fracture points in the chopped fiber and leads to ready and more complete fibrillation at reduced energy consumption, wherein pulp particle surfaces are, at least in part, defined by the location of polyaniline domains running through the fibers. As a result of that definition, at least some of the outer surfaces of the pulp have a relatively high concentration of polyaniline and an unexpectedly high electrical conductivity.

One reliable indicator of the degree of fibrillation and the level of surface area of a pulp product is known as "Canadian Standard Freeness" (CSF). The CSF of a pulp is reported as a volume of drained water determined as a result of a specified testing procedure explained herein below. Pulp eligible for use in the instant invention generally exhibits a CSF of 0 to 150 ml and preferably 20 to 100 ml. Lower CSF is generally some indication of higher surface area.

The composition of this invention may include a pulp blend combination of the two-component pulp and pulp made from other material. In that case, the composition need only contain as much of the two-component pulp as is required to achieve the desired charge decay rate. Compositions exhibiting a charge decay rate of less than five seconds are within the bounds of this invention. The amount of two-component pulp required to achieve such a charge decay rate varies depending on the amount of sulfur in the sulfonated polyaniline and the amount of sulfonated polyaniline in the two-component pulp. As a general matter, pulp blend compositions must have at least 5 weight percent two-component pulp and less than 95 weight percent of the other pulp material, based on the total weight of the composition.

The pulp component made from other material can be made from any other pulpable material including, for example, cellulosic material, acrylics, para-aramids, and the like. The preferred other pulp material is the para-aramid material, poly(p-phenylene terephthalamide).

TEST METHODS

Electric Charge Dissipation

The static decay or electric charge dissipation test measures the ability of a material, when grounded, to dissipate a known charge that has been induced on the surface of the material. To test electric charge dissipation of the pulps made in these examples, pulp was made into paper sheets and charge dissipation tests were conducted on the sheets.

Five grams of a pulp were dispersed for five minutes in 1.5 liters of water in a TMI disperser (Testing Machines, Inc., Islandia, N.Y.). The resulting slurry was poured into the head box of a laboratory handsheet machine containing 25 liters of water. A handsheet 30×30 cm was formed, dewatered, and dried.

Static Decay Rate test specimens, 9×14 cm, were cut from the handsheets, equilibrated for at least 24 hours at 30% relative humidity, and tested using an ETS Static Decay Meter, Model 406C (Electro-Tech Systems, Inc.).

In conduct of the test, the test specimens are mounted between electrodes of the Meter, a charge of 5000 volts is applied, and, on grounding the electrodes, the time is measured for the charge to drain to 500 volts. This test is Federal Test Method Standard 101B, Method 4046, known as the Static Decay Test. Test results are set out in Table IV.

Sulfur Content

A pulp sample of known weight is combusted with oxygen in a flask; and the generated $SO_2$ and $SO_3$ gases are absorbed in water. Hydrogen peroxide is added to the water to insure that all sulfur is converted to sulfate; and the water is boiled with platinum black to remove any excess $H_2O_2$. The resulting solution is combined with an equal volume of isopropanol and titrated with a standardized $BaCl_2$ solution for determination of sulfate concentration. The amount of sulfur is determined based on the sulfate concentration.

Pulp Length

Pulp fiber length is measured using a Kajaani FS-200 instrument (Kajaani Electronics, Kajaani, Finland). An aqueous slurry of pulp fibers is prepared at a concentration adequate for a rate of analysis of 40~60 fibers per second. The slurry is passed through the capillary of the instrument for exposure to a laser beam and a detector to determine the fiber length. The instrument performs calculations from the detector output and reports three different lengths;—the arithmetic average length, the length-weighted average length; and the weight-weighted average length.

Tensile Properties

Filaments tested for tensile properties are, first, conditioned at 25° C., 55% relative humidity for a minimum of 14 hours; and the tensile tests are conducted at those conditions. Tenacity (breaking tenacity), elongation (breaking elongation), and modulus are determined by breaking test filaments on an Instron tester (Instron Engineering Corp., Canton, Mass.).

Tenacity, elongation, and initial modulus, as defined in ASTM D2101-1985, are determined using filament gage lengths of 2.54 cm. Tenacity is reported in grams per denier. The modulus is calculated from the slope of the stress-strain curve at 1% strain and is equal to the stress in grams at 1% strain (absolute) times 100, divided by the test filament denier. Filament denier is determined according to ASTM D1577 using a vibrascope.

Specific Surface Area

Surface areas are determined utilizing a single point BET nitrogen absorption method using a Strohlein surface area meter (Standard Instrumentation, Inc., Charleston, W.Va.). Washed samples of pulp are dried in a tared sample flask, weighed and placed on the apparatus. Nitrogen is adsorbed at liquid nitrogen temperature. Adsorption is measured by the pressure difference between sample and reference flasks (manometer readings) and specific surface area is calculated from the manometer readings, the barometric pressure, and the sample weight.

Canadian Standard Freeness

This is a measure of the drainage of a suspension of 3 grams of fibrous material in 1 liter of water. Measurement and apparatus are according to TAPPI Standard T227 om-94. The fibrous material is dispersed for five minutes in a TMI disperser. Results are reported as volume (ml) of water drained under standard conditions. The measured value is affected by the fineness and flexibility of the fibers and by their degree of fibrillation.

EXAMPLES

Fiber preparation

In the examples that follow, the pulp composition of this invention was made with a variety of polyaniline concentrations.

Generally, a spin dope was prepared as follows: A double helix mixer (Atlantic) was heated to 800° C. under nitrogen purge and was charged with concentrated sulfuric acid (100.1%) and polyaniline while maintaining mild agitation and the nitrogen purge. Material amounts are show in Table I. (The polyaniline was dried in a vacuum oven at about 180° C. overnight.)

TABLE I

| % SPA | $H_2SO_4$ g | PA g | PPDT g | % solids |
|---|---|---|---|---|
| 5 | 145.4 | 1.75 | 33.2 | 19.4 |
| 10 | 166.2 | 4.0 | 36.0 | 19.4 |
| 20 | 153.2 | 7.0 | 28.0 | 18.6 |

The mixture was agitated for one hour at 52° C.; and was then chilled to −42° C. using a dry ice/acetone bath before adding the poly(p-phenylene terephthalamide) (PPDT). (The PPDT was dried in a vacuum oven at about 840° C. overnight.) The dry ice/acetone bath was removed and agitation of the resulting spin dope was continued for an additional hour under nitrogen at about 70° C. To deaerate the dope, it was agitated under vacuum at a temperature of about 80° C. for an additional hour, and the dope was transferred to a spin cell at 80° C.

The spin cell was set up for air gap spinning and fitted with a 10-hole spinneret with capillaries having 0.076 mm diameter and 0.23 mm length. The cell and the spinneret were maintained at 80° C. and fibers were spun through a 1 cm air gap into a water bath at about 1° C. The throughput was adjusted to achieve a jet velocity of 20.8 meters/minute and the fiber was wound at 145 meters/minute with a spin-stretch factor of 7.0. Characteristics of the resulting fiber are shown in Table II.

TABLE II

| % SPA | Dpf | Tensile | % Elonga | Modulus |
|---|---|---|---|---|
| 5 | 2.4 | 23.6 | 6.4 | 358 |
| 10 | 2.3 | 22.6 | 5.9 | 417 |
| 20 | 2.5 | 17.5 | 6.4 | 272 |

Dpf = Denier per filament
Tensile = tenacity
% Elonga = percent elongation to break
Modulus = Tensile modulus Pulp Preparation Fibers from the preceding were cut to floc with a length of 0.64 to 0.95 and the floc was refined using a 30 cm laboratory atmospheric refiner in batch mode having refiner plates from Andritz-Sprout Bauer coded "D2A501". A slurry of about 20 g floc in 700 ml water was fed to the refiner by means of a screw feeder and collected at the discharge zone of the refiner. The feeder was flushed with a small amount of water and the washings were, also, collected. The material from the first pass was fed back through the refiner and again collected. This was repeated for a total of three passes through the refiner to produce the product of this invention. Pulp characteristics for each of the several flocs are set out in Table III.

TABLE III

| | | | | Kajaani length | | |
|---|---|---|---|---|---|---|
| % SPA | CSF | SSA | % Sul | Ar | Lwt | Wwt |
| 5 | 95 | 12.9 | 11.7–12.6 | 0.24 | 0.86 | 1.88 |
| 10 | 92, 92 | 12.1 | 12.0–12/6 | N/a | N/a | N/a |
| 10 | 32, 35 | 14.6 | 12.0–12.6 | 0.35 | 0.94 | 1.81 |
| 20 | 60 | 11.9 | 10.6–10.7 | 0.35 | 0.99 | 1.80 |

CSF = Canadian Standard Freeness
SSA = Specific Surface Area in square meters per gram
% Sul = Percent sulfur based on sulfonated polyaniline
Ar = Arithmetic Average Length
Lwt = Length-Weighted Average Length
Wwt = Weight-Weighted Average Length Papers were made using this pulp and, in selected cases, this pulp combined with pulp of para-aramid. The para-aramid was poly(p-phenylene terephthalamide) and the para-aramid pulp had a CSF of 155 ml and a specific surface area of 8.5–9.5 $m^2/g$. The Static Decay Rate was determined on these papers. Test results are set out in Table IV.

TABLE IV

| % SPA* | | | Pulp Blend | Decay Time (sec) | |
|---|---|---|---|---|---|
| InPulp | CSF | SSA | SPA/Aramid | Ave. | Range |
| 5 | 95 | 12.9 | 100/0 | 1.0 | 0.6–2.0 |
| 10 | 92 | 12.1 | 100/0 | 2.7 | 1.5–3.3 |
| 20 | 60 | 11.9 | 100/0 | 0.01 | 0–0.01 |
| 20 | 60 | 11.9 | 60/40 | 0.01 | 0.01–0.01 |
| 20 | 60 | 11.9 | 30/70 | 0.01 | 0.01–0.02 |
| 20 | 60 | 11.9 | 20/80 | 0.11 | 0.08–0.17 |
| 20 | 60 | 11.9 | 10/90 | 2.7 | 1.9–3.7 |
| 0 | 155 | 8.9 | 0/100 | >30** | >30–>60** |

*Calculation based on unsulfonated polyaniline

TABLE IV-continued

| % SPA* | | | Pulp Blend | Decay Time (sec) | |
|---|---|---|---|---|---|
| InPulp | CSF | SSA | SPA/Aramid | Ave. | Range |

**Behavior typical of a non-antistatic material. The sample would not accept a full 5000 volt charge. The partial charge that was accepted was not readily dissipated. Tests were terminated after 30 or 60 seconds. In the Pulp Blends, the Aramid pulp was commercial poly (p-phenylene terephthalamide) pulp available from E. I. du Pont de Nemours and Company under the product designation, "merge 1F361".

What is claimed is:

1. A pulp composition comprising particles of 65 to 95 weight percent para-aramid and 5 to 35 weight percent sulfonated polyaniline wherein: (a) the para-aramid is present as a continuous phase and the sulfonated polyaniline is dispersed throughout the para-aramid and is, also, present as a partial exterior coating on the particles; (b) the sulfonated polyaniline has 8.5 to 15 weight percent sulfur content; and (c) the particles have a specific surface area of greater than 7.5 $m^2/g$.

2. The pulp composition of claim 1 wherein the composition exhibits a Canadian Standard Freeness of less than 150 ml.

3. The composition of claim 1 in the form of a paper.

4. The composition of claim 3 wherein the paper exhibits a charge decay rate of less than 5 seconds.

5. The composition of claim 1 wherein the para-aramid is poly(p-phenylene terephthalamide) (PPDT).

6. The composition of claim 1 in combination with other pulp material to constitute a pulp blend comprising at least 5 weight percent of the pulp composition of claim 1 and less than 95 weight percent of the other pulp material.

7. The pulp blend of claim 6 wherein the other pulp material is poly(p-phenylene terephthalamide).

* * * * *